US008057069B2

(12) United States Patent
Mangiardi et al.

(10) Patent No.: US 8,057,069 B2
(45) Date of Patent: Nov. 15, 2011

(54) GRAPHICAL USER INTERFACE MANIPULABLE LIGHTING

(75) Inventors: John R. Mangiardi, Greenwich, CT (US); John W. Gebbie, Jr., New York, NY (US)

(73) Assignee: Optimus Services AG, Maur (CH)

( * ) Notice: Subject to any disclaimer, the term of this patent is extended or adjusted under 35 U.S.C. 154(b) by 651 days.

(21) Appl. No.: 12/166,714

(22) Filed: Jul. 2, 2008

(65) Prior Publication Data

US 2009/0009984 A1 Jan. 8, 2009

Related U.S. Application Data

(60) Provisional application No. 60/947,747, filed on Jul. 3, 2007.

(51) Int. Cl.
*F21V 21/00* (2006.01)
*F21V 21/26* (2006.01)

(52) U.S. Cl. ..... 362/272; 362/249.03; 362/249.07; 362/249.09; 362/249.1; 362/269; 362/270; 362/271; 362/273; 362/274; 362/285; 362/286; 362/287; 362/372; 362/384; 362/418; 362/419; 362/427; 362/428; 362/429; 362/430

(58) Field of Classification Search ..... 362/249.01–249.19, 269–276, 362/285–287, 371, 372, 384, 394, 418–430
See application file for complete search history.

(56) References Cited

U.S. PATENT DOCUMENTS

2006/0284734 A1* 12/2006 Newman, Jr. ..... 340/825
2007/0229250 A1* 10/2007 Recker et al. ..... 340/531
2007/0268680 A1* 11/2007 Lee ..... 362/85

* cited by examiner

*Primary Examiner* — William Carter
(74) *Attorney, Agent, or Firm* — Buckley, Maschoff & Talwalkar LLC

(57) ABSTRACT

A graphical-user-interface manipulable lighting system is disclosed in which a light source having a position of focus is moved by an articulator adapted to receive and send signals through a control box indicating the current and intended positions of the focus of the light source, and further a computer interface operating wirelessly which graphically displays the current position of the light source and is adapted to allow a user to drag an icon indicating the current position of the light source onto a new intended position thereby resulting in the movement of the light source to the new position.

13 Claims, 1 Drawing Sheet

GRAPHICAL USER INTERFACE MANIPULABLE LIGHTING

CROSS-REFERENCE TO RELATED APPLICATIONS

This application claims the benefit of the provisional application No. 60/947,747 filed 3 Jul. 2007 and the complete content of this application is incorporated by reference.

FIELD OF INVENTION

This invention relates generally to an apparatus and method for controlling the focal point of light sources wirelessly and by utilizing a graphical user interface.

BACKGROUND OF THE INVENTION

There is a need for a device which will allow a user to wirelessly and seamlessly manipulate the focal point of a light source in a user-friendly manner. In many applications, light sources must be directed to a target area such as on an actor on a stage. Because these target areas move, the light source must also move with the actor. The light source can be manually moved, as by an operator moving an articulable light source by hand, in order to follow the actor. This can expose the operator to dangerous heights, high temperatures from the light source, and can result in jerky or improper following of the target. An automated system may also be used but should the target stray from the choreographed positions then the light source will no longer be correctly located. Even partially manual systems, whereby a position is tracked utilizing an electromechanical system operated by a user, thereby moving the operator from the ceiling to the ground and resulting in somewhat smoother movements, is not user friendly. If several knobs corresponding to the various axes of motion are provided to a user, said user may accidentally mistranslate the direction of the light source owing to confusion.

As such, there is a need for a device which provides a user friendly manner of directing a light source to a target and for allowing the ready tracking of a target.

SUMMARY AND OBJECTS OF THE INVENTION

The present invention is, in one embodiment, a graphical-user-interface manipulable lighting system comprising:

(a) a light source having a position of focus constituting a physical address location;

(b) an articulator for said light source adapted to receive a first signal indicating a position in a room where said position of focus of said light source is to be directed and further adapted to move said light source such that the position of focus of said light source is on the position in the room indicated by said first signal;

(c) a control box adapted to receive said first signal indicating said position in said room where the position of focus of said light source is to be directed, said control box further adapted to transmit a second signal indicating the current position of focus of said light source, said control box further adapted to transmit said first signal to said articulator; and (d) a computer adapted to transmit said first signal indicating the intended position of said focus, said computer adapted to receive a second signal indicating the current position of focus of said light source, said computer adapted to allow a user to indicate the intended position of said focus, said computer adapted to allow a user to drag a graphical icon representing the current position of focus of said light source to an intended position of said focus, said computer adapted to translate the location of said graphical icon after dragging into said first signal.

The present invention also comprises, in one embodiment, a method for tracking an object with a light source comprising the steps of:

(a) providing the graphical-user-interface manipulable lighting system above;

(b) providing a two dimensional grid on the ground and assigning each light source a digital multiplex command which provides at least one encoder and at least one step motor on said articulators the X-Y location of a section of the grid in which said X-Y location corresponds to said physical address location for said focus of the light source.

(c) locating a target on the display of said computer in which said target is an object, entity, or position on the grid;

(d) moving the iconical representation of said target on the display of said computer and thereby assigning a new physical address location for said light source; and (e) allowing said system to articulate said light source to said new physical address location.

BRIEF DESCRIPTION OF THE DRAWINGS

The present invention can best be understood in connection with the accompanying drawings. It is noted that the invention is not limited to the precise embodiments shown in drawings, in which.

BRIEF DESCRIPTION OF REFERENCE NUMERALS

100 Light and Light Articulator; 102 Operator; 104 Data and Control Stream; 106 Light Range of Motion and Grid; 108 Floor; 110 Light Beam Focal Point; 112 Perpendicular Path from Light Source to Grid; 114 Ceiling; 116 Control Unit/Tablet; 118 Antenna; 120 Light's Current Position before Movement; 122 Light's Intended Position before Movement; 124 Light's Previous Position after Movement; 126 Light's Current Position after Movement.

DETAILED DESCRIPTION OF THE INVENTION

In one preferred embodiment of the invention, light tracking is accomplished by laying down a two dimensional grid on the ground and assigning each articulable or robotic light a digital multiplex ("DMX") command that provides the encoders and step motors (that control the articulable or robotic light) the X-Y location of that section of the grid. Any communications protocol, including DMX512-A, RS-485 based communications protocols, or other protocols useful for controlling stage lighting and generally known in the art, may be used to provide a DMX or other command. In an embodiment for an operating room, approximately four inch squares within a fifteen foot circle centered on the center-point of an operating table therein may be provided to form the grid.

Once these "addresses" have been assigned in physical space by an installer of the lighting units, a virtual grid is rendered on a GUI interface of a computer, and each corresponding grid mark location in the rendering is assigned the same location address. When the user "grabs" the virtual light spot in the GUI, and "moves" it to a different location, the software varies the address instructions as the spot is moved in the GUI, and the robotic lighting controllers move the light along the path of the corresponding address assignments. As a result, a user is induced to feel that they are "moving" the light; whereas they are actually merely assigning new address locations to the robotic or articulable lighting control devices which then redirect the lights.

Figure 1:
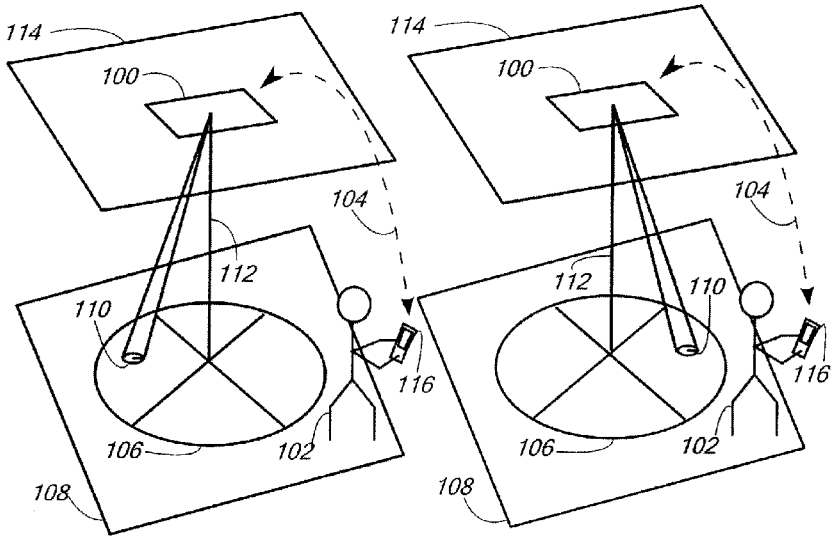
FIG. 1 presents a view of a room in which a light source is directed to a point and a room where that light source is directed to another point.
Figure 2:
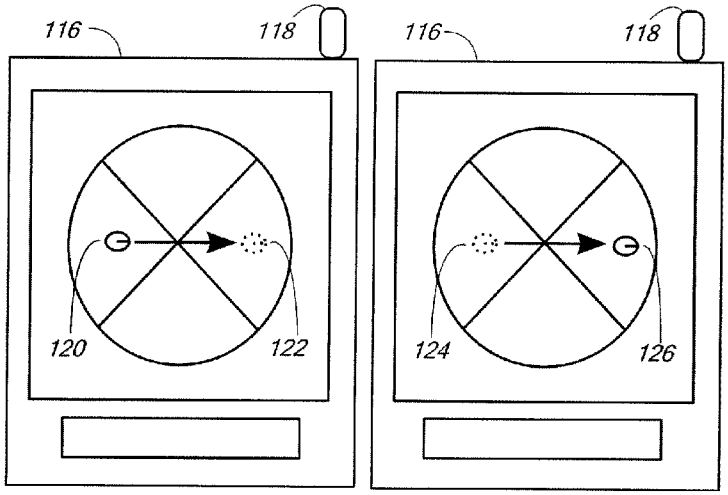
FIG. 2 presents a view of a tablet control unit displaying a view of a light source point in a graphical user interface indicating the light source point's location and a view of a tablet after the light source point has been moved.

FIG. 1 provides a simplified view of the operation of another embodiment of the present invention. Light and light articulator 100 are positioned on or in a ceiling 114 and may further comprise a control box. Light source 100 has a position of focus 110 which is typically offset from the path defined by 112. The light articulator 100 can receive a signal from a control box (not shown) which contains data comprising an intended position in a room where the focal point 110 is to be directed. The light articulator 100 receives these instructions and then directs the focal point to a new position 110 in the room. The control box operates to receive the signal containing the position information wirelessly and also transmits trajectory and position information regarding the light source to a computer 116. As mentioned, the control box sends corresponding location information to the articulator 100. A computer 116 having an antenna or other wireless interface 118 provides the graphical user interface for use by an operator 102. The computer is adapted to transmit a signal containing a user's intended target for the light source and is further adapted to receive information as to the light source's current trajectory and position. This wireless communication 104 is also seen in FIG. 1. The computer displays the light source's current focal point in a graphical manner on its screen. The screen displays a grid showing the operational bounds of the light source, the position of the light source 120 and 126, the trajectory (if any) of the light source, the prior position of the light source 124 and the intended position 126 (if moving) of the light source. Other information controllable and displayable include selection of light sources, selection of color mixtures and intensities, and other light source information. The computer may also display an icon indicating the position of an object or person relative to the focus of said light source. If the person or object is tagged with a wireless locator, the computer can display in real-time the present location of the person and may display further information such as the anticipated location of the person (such as with but not limited to stage directions).

In a preferred embodiment, a user 102 operates the computer 116 by touching the screen at the point containing an icon representing the position of the light and dragging the position (indicated by the arrow between 120 and 122 & 124 and 126 in FIG. 1) to the user's 116 intended position 122. The icon moves in real time as the light source is articulated until the final position 126 is reached. Other interface means are also contemplated including keyboard or mouse control. The user may use a pen, fingers, or other objects if the computer is adapted with a touch-sensitive screen. The computer may be of any type including laptops, desktops, and preferably tablet or table-type models.

In one application of an embodiment of the invention, the system is used to track an actor on a stage. An operator may observe the actor on the stage and drag the iconical representation of the focal point of the light source to correspond to the actor's position. As the actor's position changes, the operator may drag the iconical representation accordingly. If the target is wearing a locator means, such as a radio-frequency identification ("RFID") device, a BLUE-TOOTH device, a transponder, or other location means, then the computer can be commanded to automatically adjust the light source to follow the actor.

In another application, the system can be used in an operating room or other hospital environment. A patient (or even a surgeon or other staff member) can be affixed with a location device or a surgeon or other operator can simply track a patient's position using the graphical user interface on the computer. With multiple light sources, the computer can be used to track—either manually or automatically—a number of persons or patients in a room. Such a system could be integrated with other devices in the room. For example, a table may exist in the room whereupon a patient is placed. If the table is to be adjusted, such as by rotating the table such that the head of the table spins about the center axis of the table, then the computer can be linked to move the light source such that the light source is in constant placement over a portion or portions of the patient. In this manner, for example, a patient's head can remain illuminated while the patient is moved.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention. It is further known that other modifications may be made to the present invention, without departing the scope of the invention, as noted in the appended claims.

We claim:

1. A graphical-user-interface manipulable lighting system comprising:

(a) a light source having a position of focus constituting a physical address location;

(b) an articulator for said light source adapted to receive a first signal indicating a position in a room where said position of focus of said light source is to be directed and further adapted to move said light source such that the position of focus of said light source is on the position in the room indicated by said first signal;

(c) a control box adapted to receive said first signal indicating said position in said room where the position of focus of said light source is to be directed, said control box further adapted to transmit a second signal indicating the current position of focus of said light source, said control box further adapted to transmit said first signal to said articulator; and (d) a computer adapted to transmit said first signal indicating the intended position of said focus, said computer adapted to receive a second signal indicating the current position of focus of said light source, said computer adapted to allow a user to indicate the intended position of said focus, said computer adapted to allow a user to drag a graphical icon representing the current position of focus of said light source to an intended position of said focus, said computer adapted to translate the location of said graphical icon after dragging into said first signal, and wherein said computer displays an icon indicating the position of an object or person relative to the focus of said light source and the icon tracks the position of said object or person as said object or person moves.

2. The system of claim 1 in which said computer is a tablet.

3. The system of claim 1 in which said computer has a touch-sensitive interface adapted to allow dragging and dropping of icons by contact of the graphical representation of an icon with a finger or pen.

4. The system of claim 1 in which said system is further adapted to display and allow control over multiple light sources.

5. The system of claim 4 in which said control further comprises control over said multiple light sources color, temperature, intensity, or strobe.

6. The system of claim 1 in which said control box is adapted to provide digital multiplex commands to said articulator.

7. A method for tracking an object with a light source comprising the steps of:

(a) providing with a graphical-user-interface manipulable lighting system comprising: a light source having a position of focus constituting a physical address location; an articulator for said light source adapted to receive a first signal indicating a position in a room where said position of focus of said light source is to be directed and further adapted to move said light source such that the position of focus of said light source is on the position in the room indicated by said first signal; a control box adapted to receive said first signal indicated said position in said room where the position of focus of said light source is to be directed, said control box further adapted to transmit a second signal indicating the current position of focus of said light source, said control box further adapted to transmit said first signal to said articulator; and a computer adapted to transmit said first signal indicating the intended position of said focus, said computer adapted to receive a second signal indicating the current position of the focus of said light source, said computer adapted to allow a user to indicate the intended position of said focus, said computer adapted to allow a user to drag a graphical icon representing the current position of focus of said light source to an intended position of said focus, said computer adapted to translate the location of said graphical icon after dragging into said first signal, and wherein said computer displays an icon indicating the position of an object or person relative to the focus of said light source and the icon tracks the position of said object or person as said object or person moves; wherein said control box is adapted to provide digital multiplex commands to said articulator;

(b) providing a two dimensional grid on the ground and assigning each light source a digital multiplex command which provides at least one encoder and at least one step motor on said articulators the X-Y location of a section of the grid in which said X-Y location corresponds to said physical address location for said focus of the light source;

(c) locating a target on the display of said computer in which said target is an object, entity, or position on the grid;

(d) moving the iconical representation of said target on the display of said computer and thereby assigning a new physical address location for said light source; and (e) allowing said system to articulate said light source to said new physical address location.

8. The method of claim 7 in which said iconical representation can be dragged by a finger or other object touching the display of said computer.

9. The method of claim 8 in which said target is followed automatically by the light source via said computer controlling the focal point of said light source.

10. The method of claim 7 in which said target is an actor.

11. The method of claim 7 in which said target is a patient in a hospital room.

12. The method of claim 7 in which said target is a patient in a hospital room and said system of claim 1 is integrated with a table in said hospital room such that when said table moves, said system adjusts the focal point of said light source to track a position on said table.

13. The method of claim 7 in which said grid comprises 3 inch squares within a fifteen foot circle centered on a centerpoint of an operating room table.

* * * * *